US012325064B2

(12) United States Patent
Schivalocchi

(10) Patent No.: US 12,325,064 B2
(45) Date of Patent: Jun. 10, 2025

(54) HEAD AND LUBRICATED PISTON

(71) Applicant: COPROMEC DIE CASTING S.R.L. A SOCIO UNICO, Roè Volciano (IT)

(72) Inventor: Carlo Schivalocchi, Brescia (IT)

(73) Assignee: COPROMEC DIE CASTING S.R.L. A SOCIO UNICO, Roè Volciano (IT)

( * ) Notice: Subject to any disclaimer, the term of this patent is extended or adjusted under 35 U.S.C. 154(b) by 0 days.

(21) Appl. No.: 18/285,426

(22) PCT Filed: Jan. 14, 2021

(86) PCT No.: PCT/IB2021/050242
§ 371 (c)(1),
(2) Date: Oct. 3, 2023

(87) PCT Pub. No.: WO2021/144722
PCT Pub. Date: Jul. 22, 2021

(65) Prior Publication Data

US 2024/0181524 A1 Jun. 6, 2024

(30) Foreign Application Priority Data

Jan. 14, 2020 (IT) ..... 102020000000553

(51) Int. Cl.
*B22D 17/20* (2006.01)

(52) U.S. Cl.
CPC ..... *B22D 17/203* (2013.01); *B22D 17/2038* (2013.01)

(58) Field of Classification Search
CPC ..... B22D 17/203; B22D 17/2038
See application file for complete search history.

(56) References Cited

U.S. PATENT DOCUMENTS

2012/0180973 A1* 7/2012 Werner ..... B22D 17/14 164/253
2015/0096439 A1* 4/2015 Schivalocchi ..... F04B 53/14 92/172
2021/0162492 A1* 6/2021 Bogan ..... B22D 17/2038

FOREIGN PATENT DOCUMENTS

DE 19938076 A1 * 2/2001 ..... B22D 17/203
JP 2010269319 A * 12/2010
WO 2009146568 A1 12/2009
WO 2013001469 A1 1/2013
WO 2013098917 A1 4/2013

OTHER PUBLICATIONS

Machine Translation of WO 2013/098917 (published Jul. 4, 2013, cited in IDS filed Oct. 3, 2023) (Year: 2013).*

* cited by examiner

*Primary Examiner* — Kevin E Yoon
*Assistant Examiner* — Jacky Yuen
(74) *Attorney, Agent, or Firm* — ArentFox Schiff LLP; Michael Fainberg

(57) ABSTRACT

A piston head for making a piston of a press for a die-casting machine comprises a head body wherein at least one ring seat suitable to receive a respective sealing ring, is obtained. A lubrication circuit is obtained in the head body and comprises at least one lubrication end duct leading into a surface channel which runs through the bottom wall of the ring seat in order to convey the lubricant towards gaps between sealing ring and head.

12 Claims, 10 Drawing Sheets

HEAD AND LUBRICATED PISTON

CROSS-REFERENCE TO RELATED APPLICATIONS

This application is a National Phase Application of PCT International Application No. PCT/IB2021/050242, having an International Filing Date of Jan. 14, 2021 which claims priority to Italian Application No. 102020000000553 filed Jan. 14, 2020, each of which is hereby incorporated by reference in its entirety.

The object of the present invention is a piston head and a piston of a press for a die-casting machine, for example of the cold chamber type. In particular, the present invention relates to a piston with a lubrication circuit suitable to facilitate the sliding of the piston in a molten metal container of a press for the die-casting machine.

BACKGROUND OF THE INVENTION

WO2013001469A1 to the same Applicant proposes a piston for a die-casting machine comprising a piston head having a side wall in which a ring seat is obtained in which there is housed a sealing ring suitable to create a seal on the wall of the container of the press in which the piston slides. A lubrication circuit suitable to facilitate the sliding of the piston in the container of the die-casting machine is obtained in the head body.

The lubrication circuit comprises at least one lubrication end duct leading into the ring seat so as to be covered by the sealing ring so that the lubricant flows out of the piston head through the gaps between the sealing ring and the piston head.

Such an embodiment of the piston n allows the lubricant to reach the area of greatest friction between the piston and the container in a targeted manner.

However, the Applicant has discovered that the axial and radial loads to which the sealing ring are subjected in certain cases are such as to induce a complete occlusion of the openings of the end ducts under the ring and/or of the gaps from which the lubricant should flow out.

It is the object of the present invention to propose a piston head provided with lubrication circuit but capable of obviating the above-described drawback.

Such an object is achieved with a piston head, with a head assembly, and with a piston.

BRIEF DESCRIPTION OF THE DRAWINGS

The features and advantages of the piston head according to the present invention will be apparent from the following description, given by way of preferred non-limiting examples, to according the accompanying drawings. In said drawings.

DETAILED DESCRIPTION

Figure 1A:
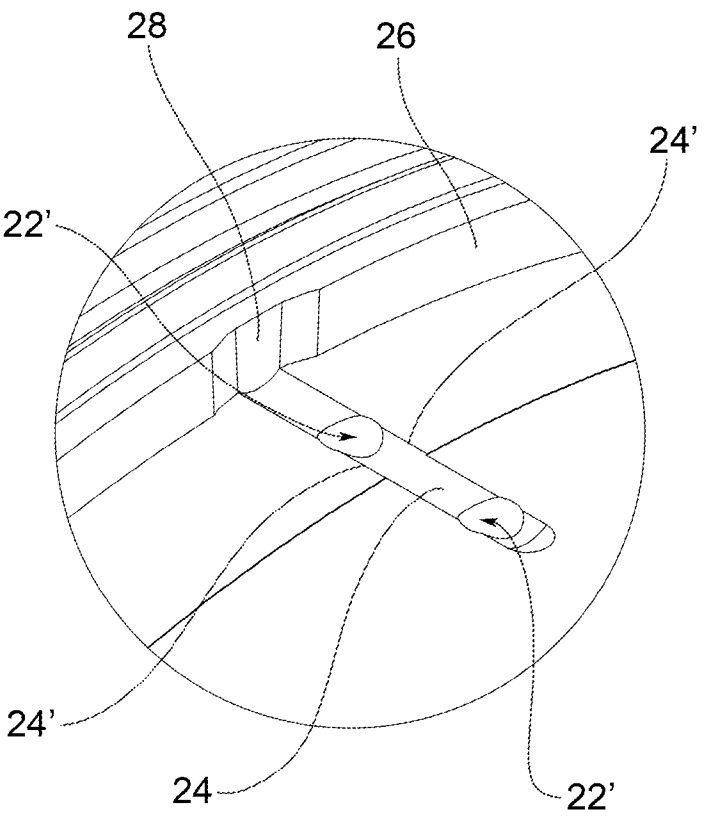
FIG. 1*a* is an enlarged view of circled detail A in FIG. 1.
Figure 1:
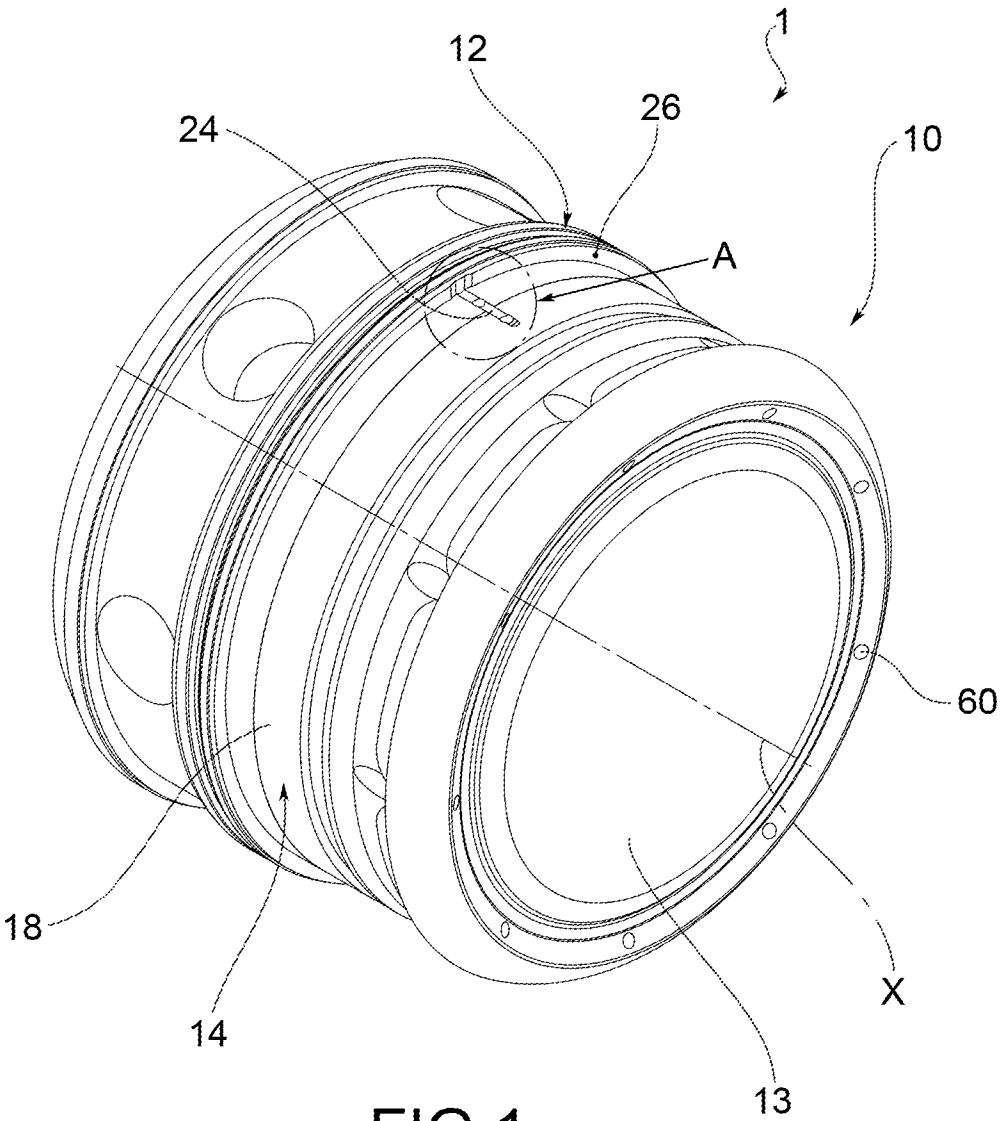
FIG. 1 is a perspective view of a piston head according to the invention, in an embodiment.

In said drawings, elements which are common to the various embodiments are indicated by the same reference numerals.

Figures 6, 6A, 6B:
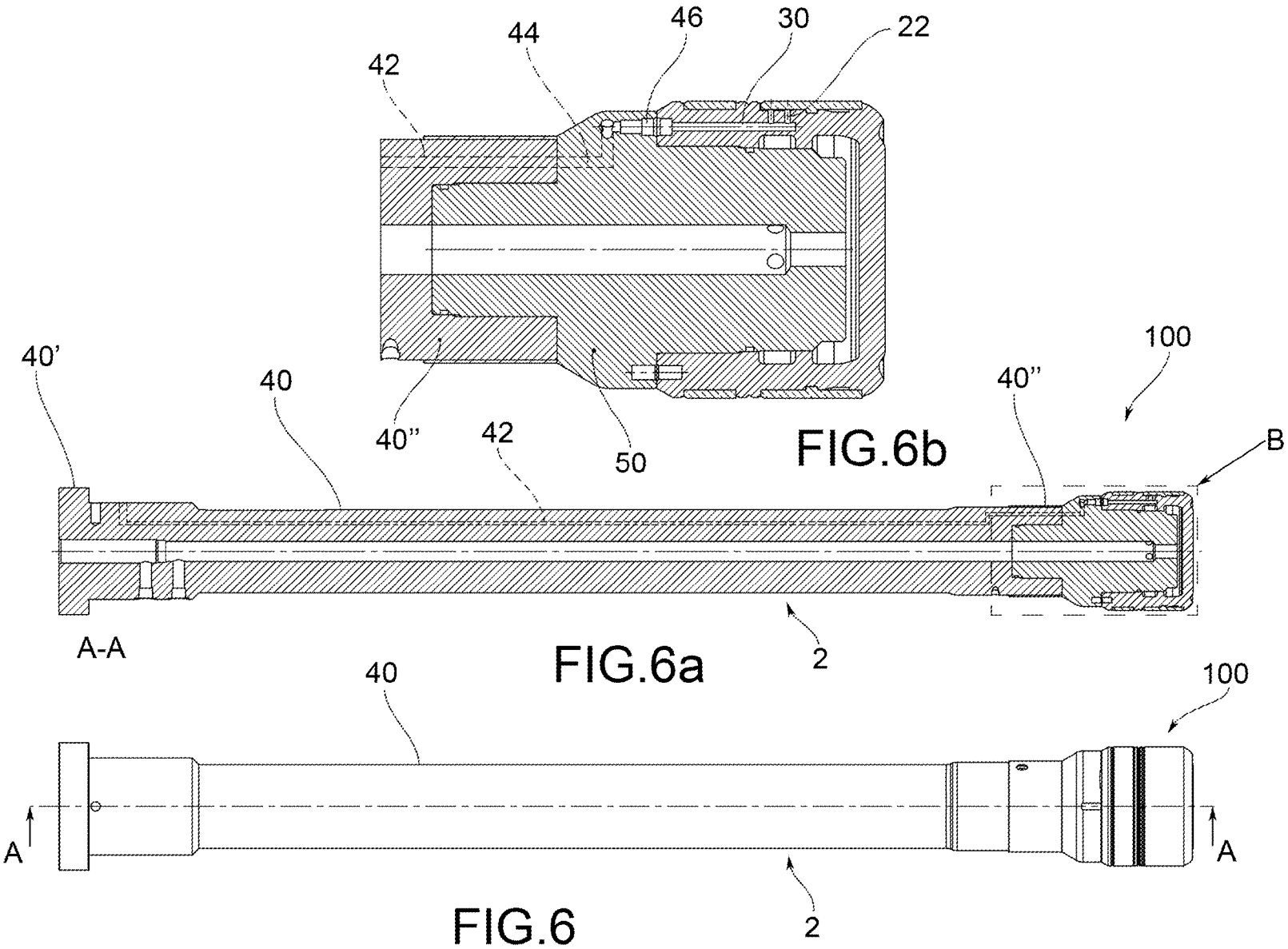
FIG. 6 is a side view of a piston of a press for a die-casting machine, comprising a head assembly of the preceding drawings.
FIG. 6*a* is an axial section of the piston.
FIG. 6*b* is an enlarged view of the end part in square B in FIG. 6*a;*

With reference to the accompanying drawings, numeral 1 indicates a piston head for making a piston 2, an example of which is shown in FIGS. 6 and 6*a*, of a press for a die-casting machine, for example of the cold chamber type. The press comprises a container in which piston 2 is slidingly housed, or at least an end part thereof for pushing the molten metal.

The piston head 1 comprises a head body 10 having a side wall 12 extending about a head axis X. The head body ends at the front with a front wall 13 for pushing the molten metal.

In the continuation of the description, the terms front and back, or equivalent terms, refer to the advancement direction of piston 2 in pushing step of the molten metal.

A ring seat 14 suitable to receive a respective sealing ring 16 is obtained in the side wall 12. The ring seat 14 forms a cylindrical bottom wall 18 parallel to the head axis X.

A lubrication circuit 20 suitable to facilitate the sliding of piston 2 in the container of the press of the die-casting machine is obtained in the head body 10.

Figure 5A:
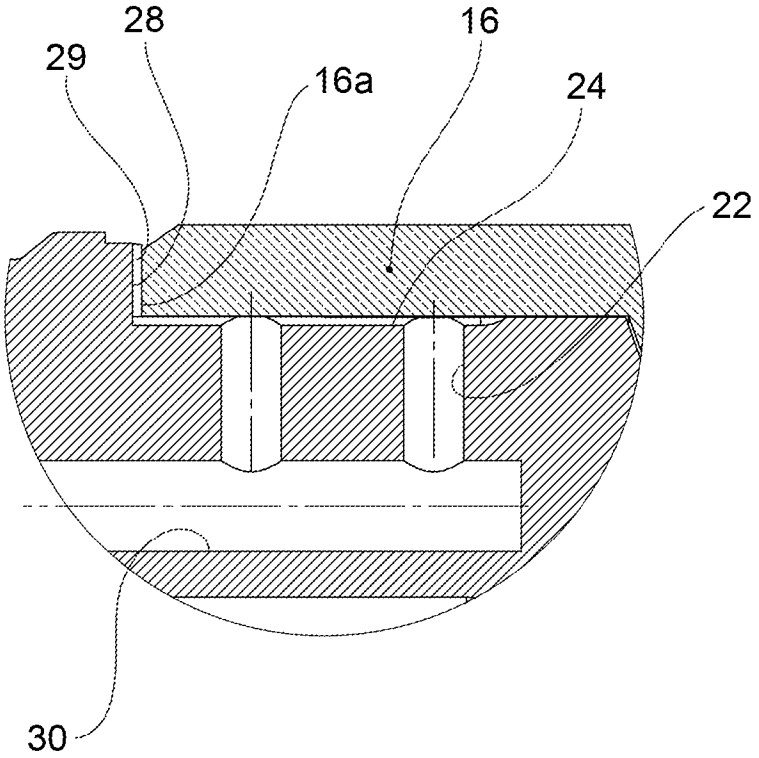
FIG. 5*a* is an enlarged view of circled detail B in FIG. 5.
Figure 5:
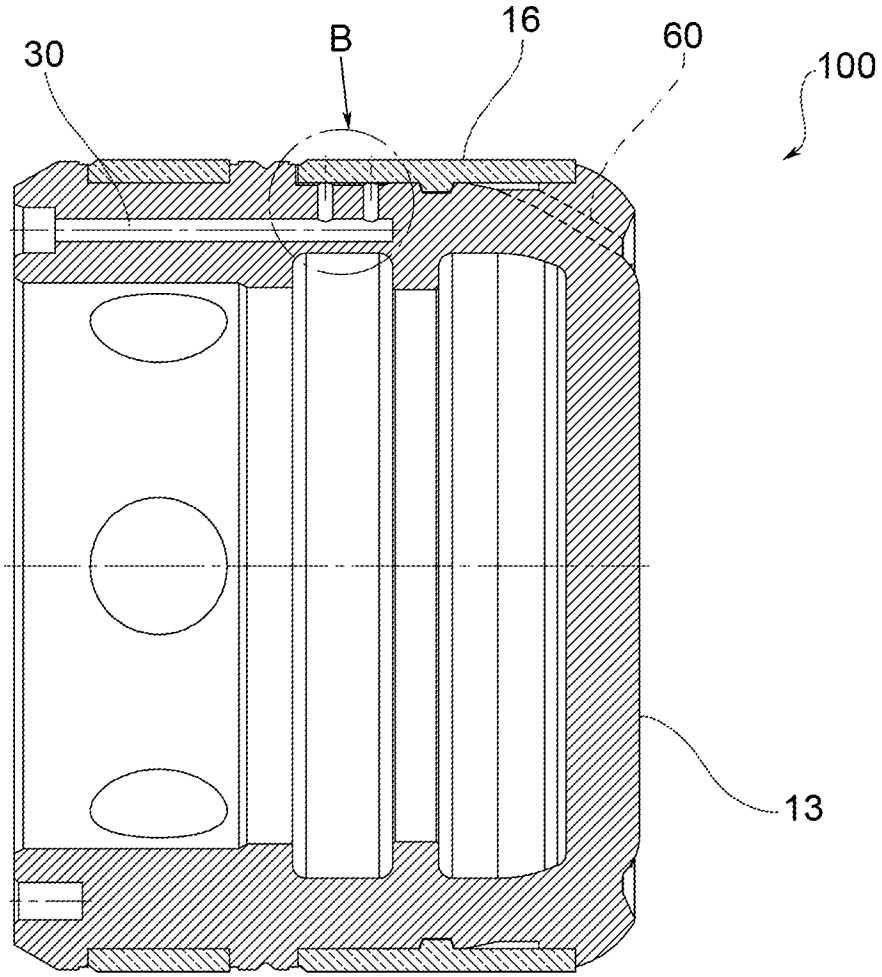
FIG. 5 is an axial section of the head assembly in FIG. 4.

The lubrication circuit 20 comprises at least one lubrication end duct 22 leading into the ring seat 14 so as to be covered by the sealing ring 16 when the sealing ring 16 is housed in the ring seat 14, as shown, for example in FIGS. 5 and 5*a*.

Thereby, the lubricant flows out of the piston head 1 through the gaps between the sealing ring 16 and the piston head 1.

According to an aspect of the invention, at least one lubrication end duct 22 leads into a surface channel 24 which runs through the bottom wall 18 of the ring seat 14 in order to convey the lubricant towards the gaps.

By virtue of the presence of this surface channel 24, even if the sealing ring 16 were subjected to radial loads to the point of being compressed with the radially inner side thereof against the bottom wall 18, the lubricant could in any case flow out of the end ducts 22 into the surface channel 24, which is lowered with respect to the bottom wall 18, thus reaching the gaps between sealing ring 16 and the piston head.

In particular, in an embodiment shown in FIGS. 1 to 8, the ring seat 14 is delimited at the back by an annular shoulder 26. The surface channel 24 ends at the base of such an annular shoulder 26.

In other words, a gap for the lubricant to flow out of is given by the rear slit between the sealing ring 16 and the annular shoulder 26 which locks the sealing ring at the back in axial direction.

The surface channel 24 therefore puts the lubrication end ducts 22 in communication with such a slit.

In an embodiment, the surface channel 24 extends parallel to the head axis X.

In an embodiment, the annular shoulder 26 forms, at the surface channel 24, an axial recess 28 suitable to locally increase the passage cross-section of the lubricant in the gap between the annular shoulder 26 and the sealing ring 16.

In other words, a concave portion, i.e. a recess, extending from the rear end of the surface channel 24, is obtained in the vertical wall of the annular shoulder 26. Such an axial recess 28 thus forms a preferential passageway 29 (shown in FIG. 4*a*) for the outflow of the lubricant.

It should be noted that both this preferential passageway 29 and the surface channel 24 are sized so as to allow the passage of the lubricant, but not of the metal in the molten state. Therefore, the lubrication circuit, and the outflow of the lubricant from the piston head in particular, are perfectly functional and effective also during the continuous operation of the piston.

Such a passageway 29 can not be occluded by the sealing ring 16 also when this is subjected to axial loads such as to compress the rear side thereof against the annular shoulder 26.

In an embodiment, the surface channel 24 has a bottom wall in the shape of an arc of circumference, i.e. it comprises of a cylindrical portion of wall.

Figure 2A:
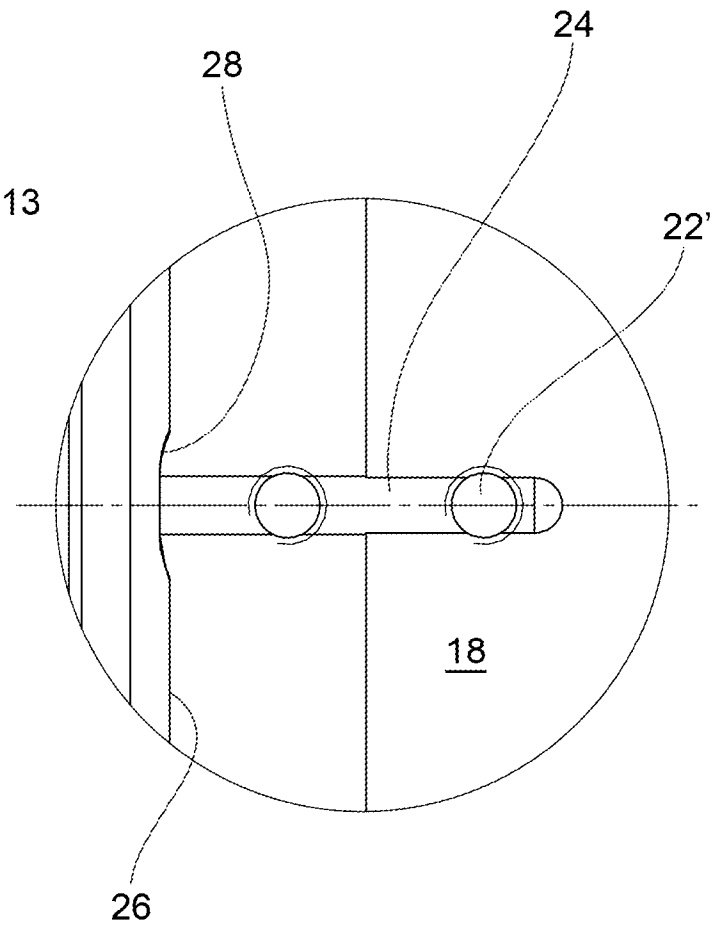
FIG. 2*a* is an enlarged view of circled detail B in FIG. 2.
Figure 2:
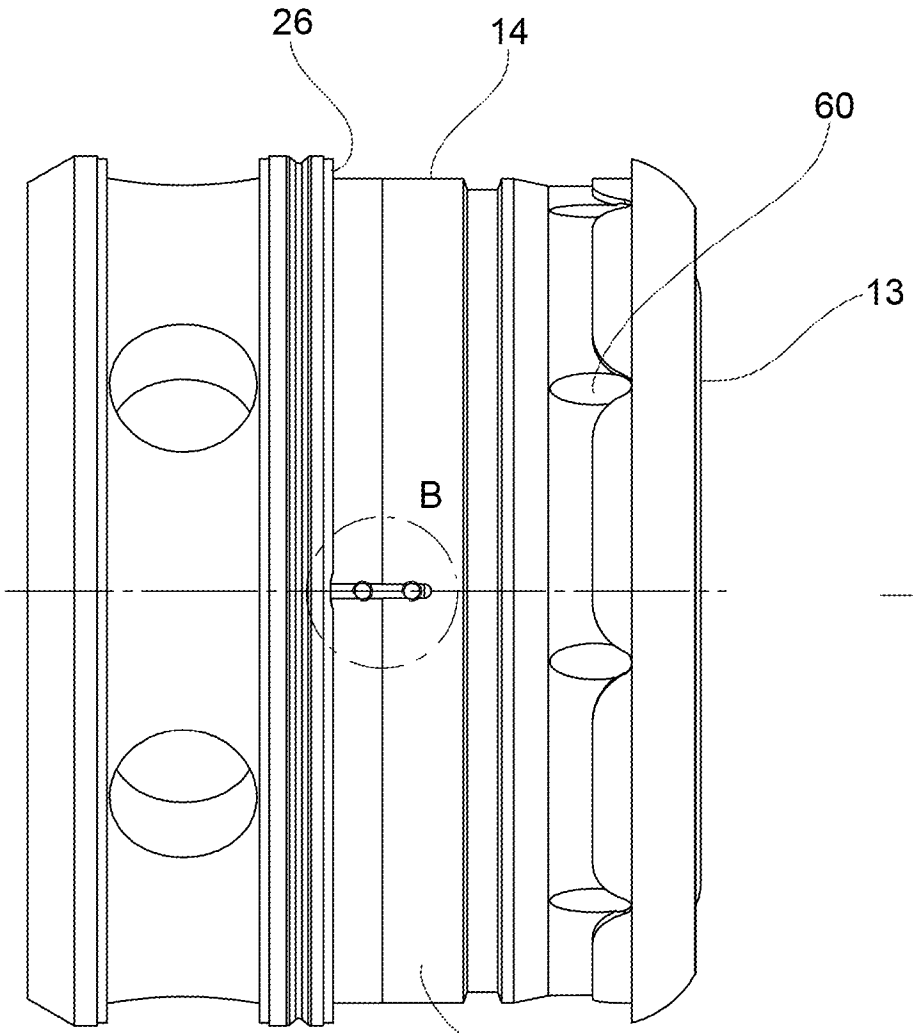
FIG. 2 is a side view of the piston head in FIG. 1.
Figure 3A:
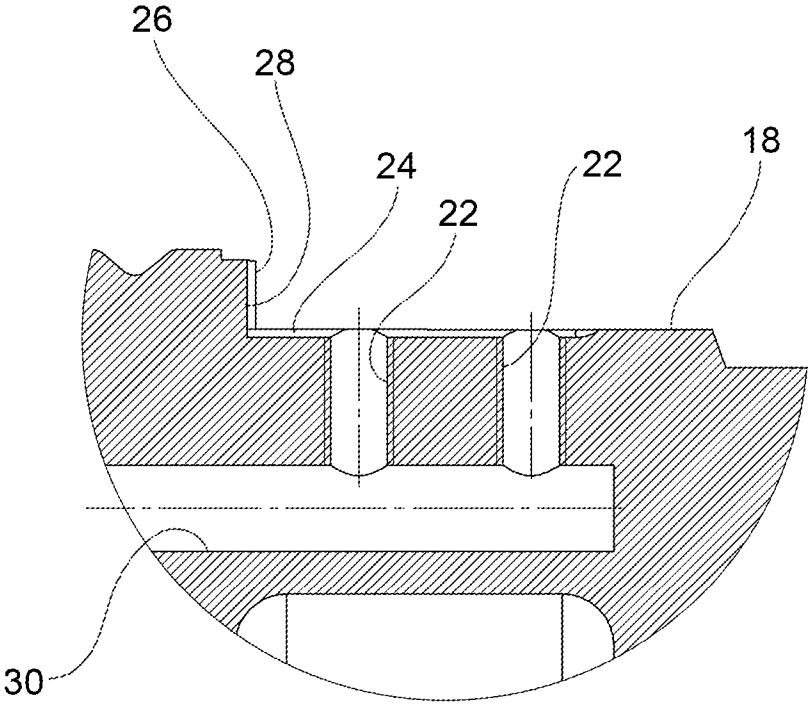
FIG. 3*a* is an enlarged view of circled detail B in FIG. 3.
Figure 3:
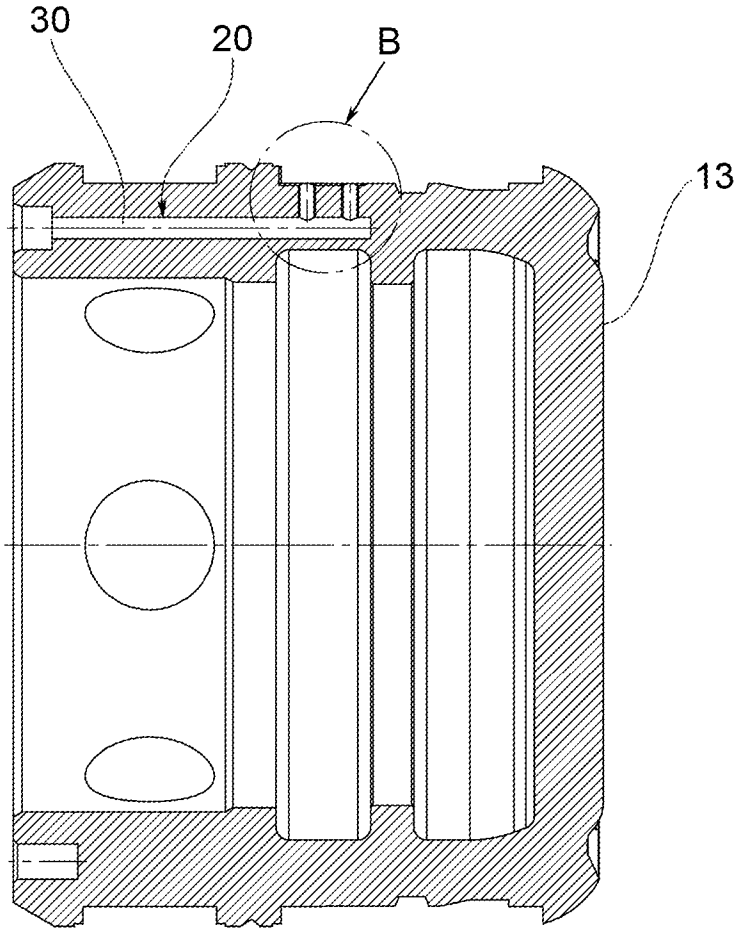
FIG. 3 is an axial section of the piston head.

In an embodiment, the surface channel 24 is axially delimited by two parallel edges 24'. The outlet opening 22' of each lubrication end duct 22 has a circular cross-section with a diameter greater than the distance between such parallel edges 24', as is particularly shown in the enlarged view in FIGS. 1*a* and 2*a*.

In an embodiment, the outlet opening 22' of each end duct 22 is provided with a threaded wall so as to screw therein a threaded cap (not shown) for modulating or even preventing the passage of lubricant from the end duct 22.

In an embodiment, the lubrication circuit 20 obtained in the head body 10 comprises at least one proximal duct 30, for example parallel to the head axis X, which comes from, or is connected to respective lubrication ducts obtained in the rod. Two parallel end ducts 22, both leading into the surface channel 24 radially extend from such a proximal duct 30.

Figures 4, 4A:
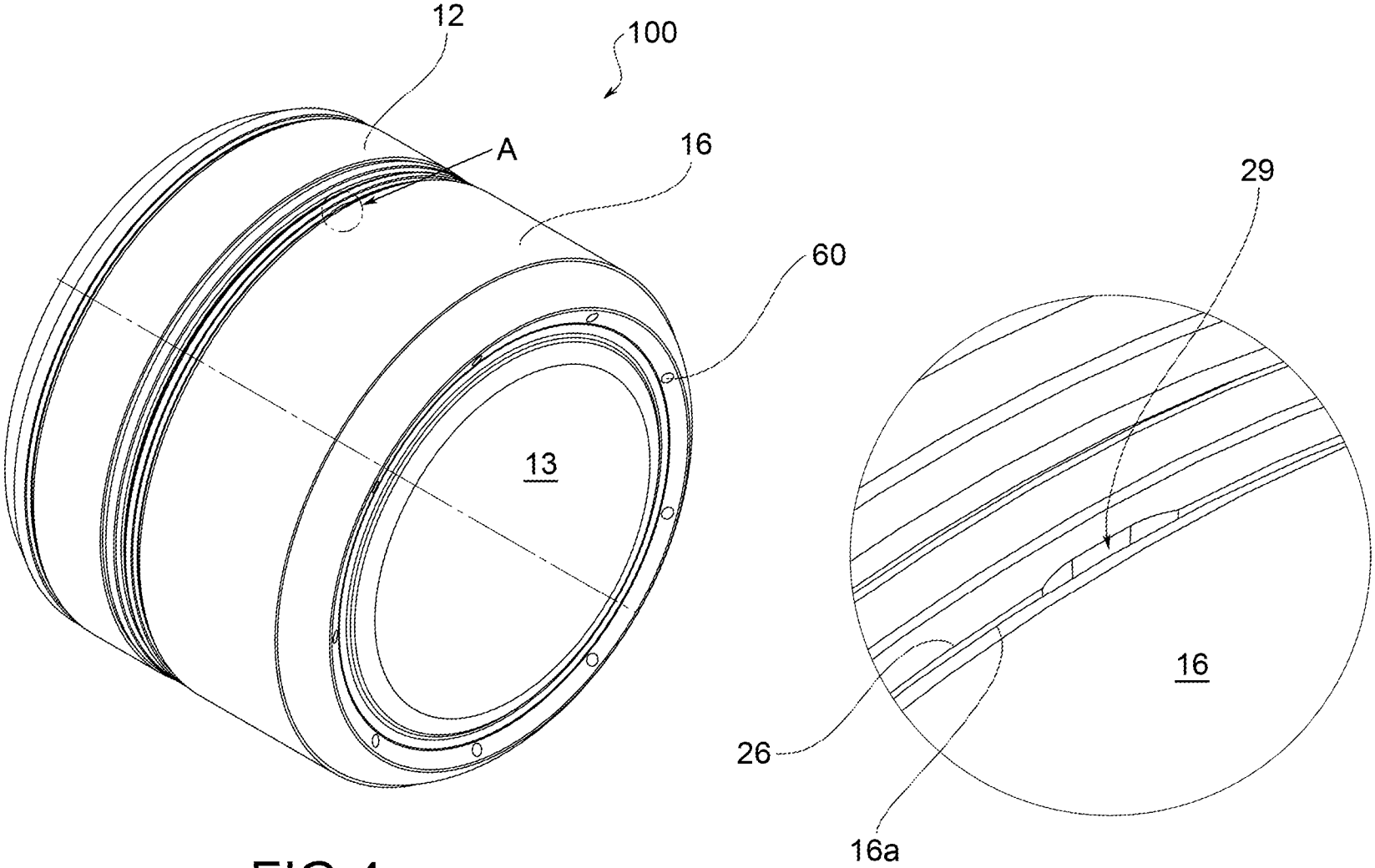
FIG. 4 is a perspective view of a head assembly comprising the piston head in the preceding drawings, and a sealing ring placed about the head.
FIG. 4*a* is an enlarged view of circled detail A in FIG. 4.

FIGS. 4 and 5 show a head assembly 100 comprising the piston head 1 and the sealing ring 16 positioned in the ring seat 14.

The sealing ring 16 is in the shape of a band, i.e. it has a much greater axial extension than the thickness thereof. For example, the sealing ring 16 is made of a copper alloy.

As is shown in particular in FIG. 5*a*, the sealing ring 16 covers the lubrication end ducts 22 and, with the piston head 1, forms gaps for the outflow of the lubricant. In particular, the sealing ring 16 comprises a substantially circular annular rear wall 16*a* suitable to be axially engaged by the annular shoulder 26.

In an embodiment, the sealing ring 16 is interrupted by a longitudinal slit (not shown) which allows the ring to be open, and therefore fitted on the piston head 1 for the positioning thereof in the ring seat 14.

Such a longitudinal slit can comprise of gaps for the outflow of the lubricant.

FIGS. 6 and 6*a* show an example of piston 2 of a press for a die-casting machine. The piston 2 comprises a head assembly 100 as described above, and a rod 40 which extends between a rear, or proximal, end 40' and a front, or distal, end 40" for connection to the head assembly 100.

In the embodiment shown, the head assembly 100 is mounted on a support pin 50, which in turn is fastened to the front end 40" of rod 40.

One or more lubricant supply ducts 42 fluidically connected to the lubrication end ducts 22 are obtained in rod 40.

For example, such supply ducts 42 lead into respective intermediate ducts 44 obtained in the support pin 50, which intermediate ducts 44 are in turn connected to the end ducts 22.

In an embodiment, the intermediate ducts 44 are connected to the respective proximal ducts 30 by means of connection bushes 46.

In the embodiment in FIGS. 1 to 6, passageways or inner channels 60 connecting an annular portion of the front wall 13, for example an inclined or concave annular portion, to the ring seat 14 are obtained in a front portion of the piston head 1. Such passageways or inner channels 60 allow an outflow of molten metal below the sealing ring 16 which by solidifying, creates a thickness which compensates for the wear of the sealing ring.

Figure 7:
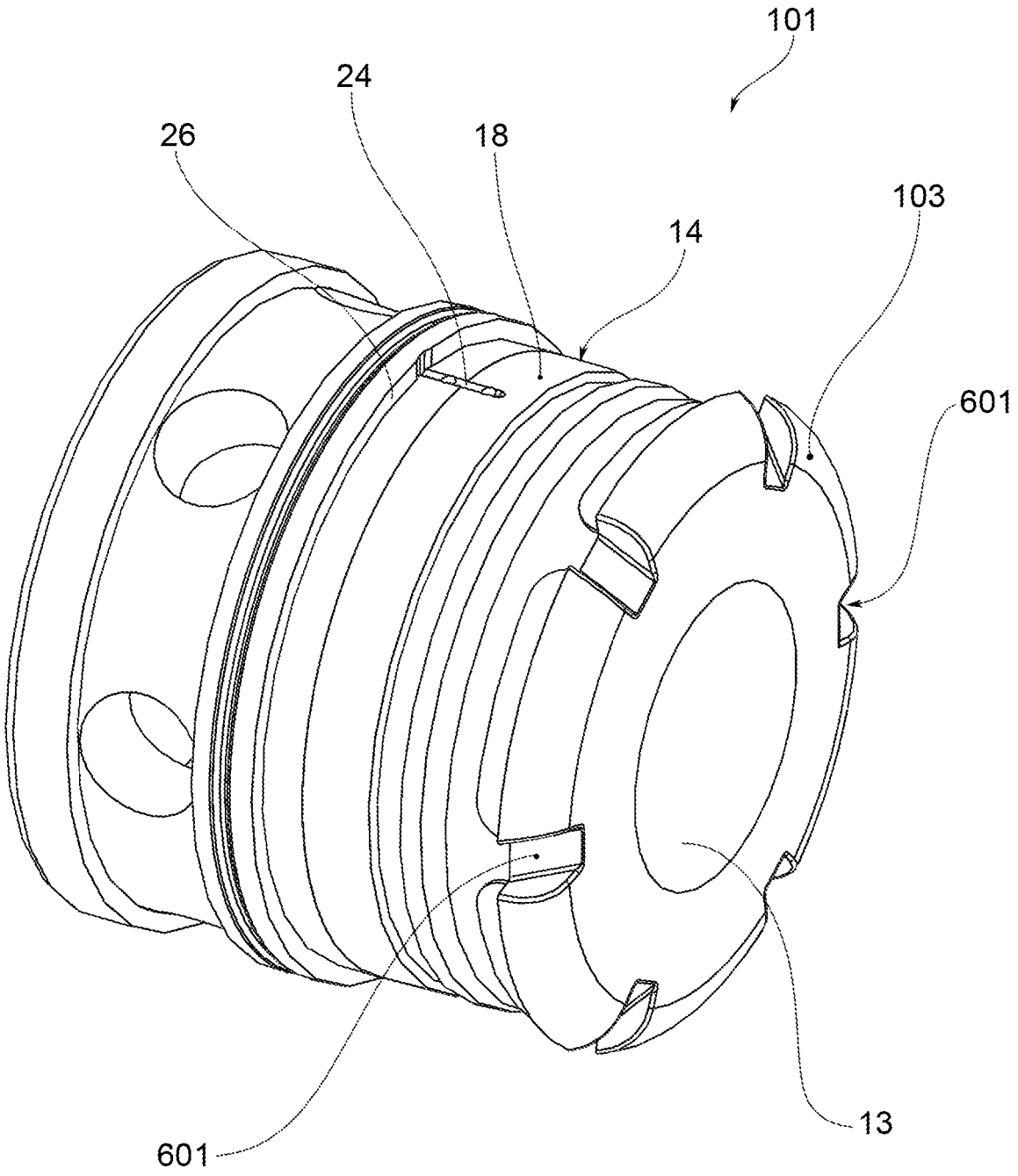
FIGS. 7 and 8 are two a perspective views of a piston head according to the invention, in further embodiments.

FIG. 7 shows another example of piston head 101 according to the invention. With respect to the piston head 1 described above, a plurality of outer channels 601 is obtained in place of the passageways or inner ducts 60, in a front portion 103 of the head body separating the ring seat 14 from the front wall 13. Also these outer channels 601 put the front wall 13 in communication with the bottom wall 18 of the ring seat 14.

Figure 8:
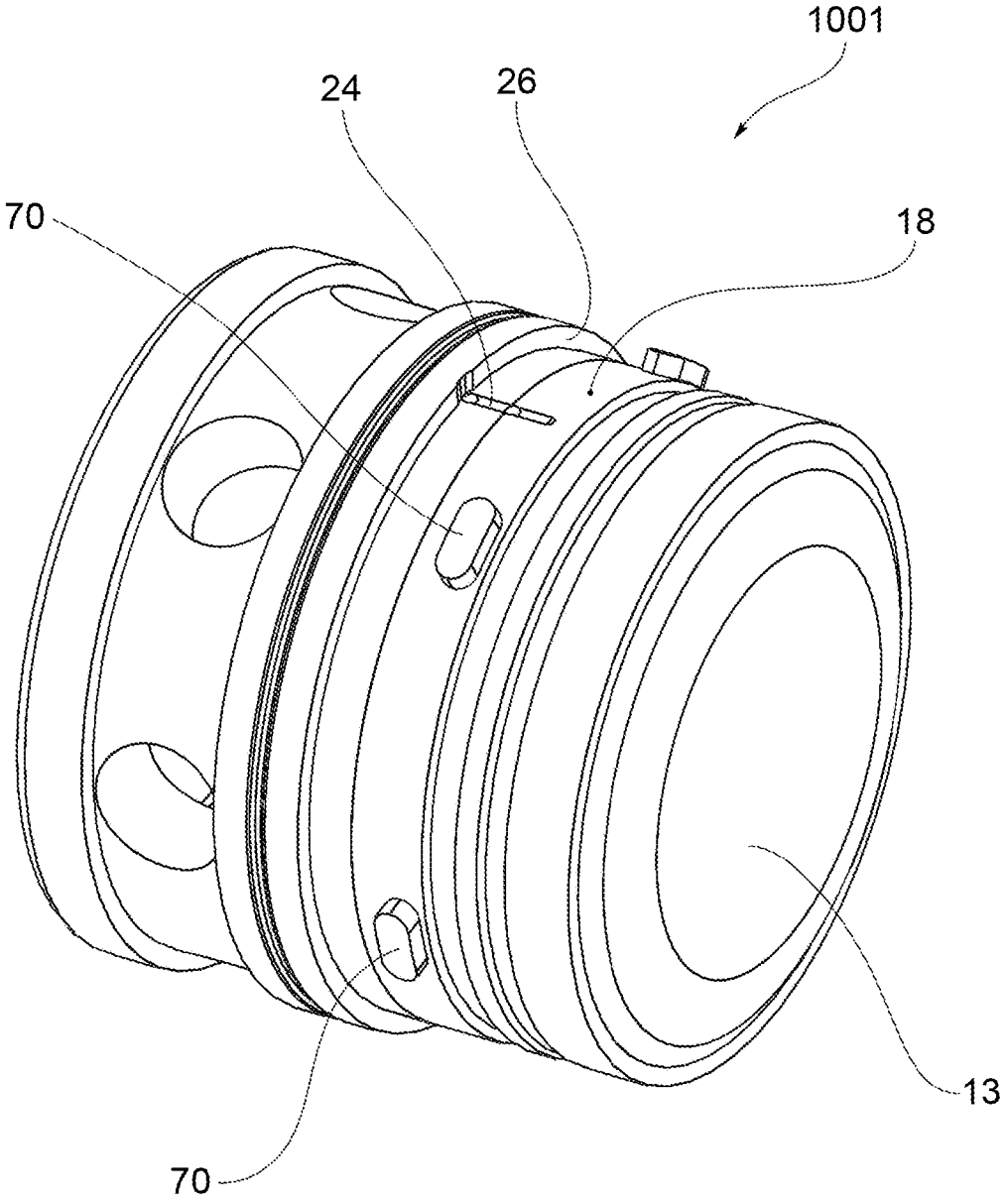

FIG. 8 shows another example of piston head 1001 according to the invention. With respect to the piston heads 1, 101 described above, this piston head 1001 is provided with radial protrusions 70 extending from the bottom wall 18 of the ring seat 14 and which are suitable to engage, with shape coupling, corresponding openings 72 made in the sealing ring 16 so as to create an axial and radial locking system of the sealing ring 16.

Figure 9:
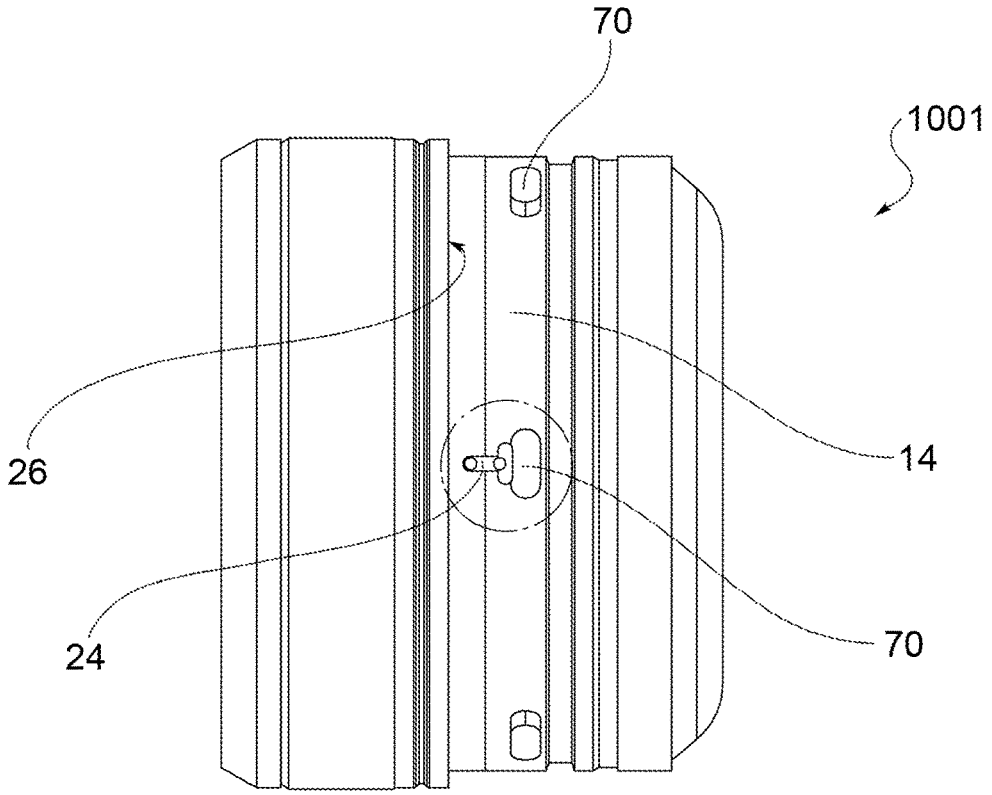
FIG. 9 is a side view of a piston head according to the invention, in a further embodiment.
Figure 10:
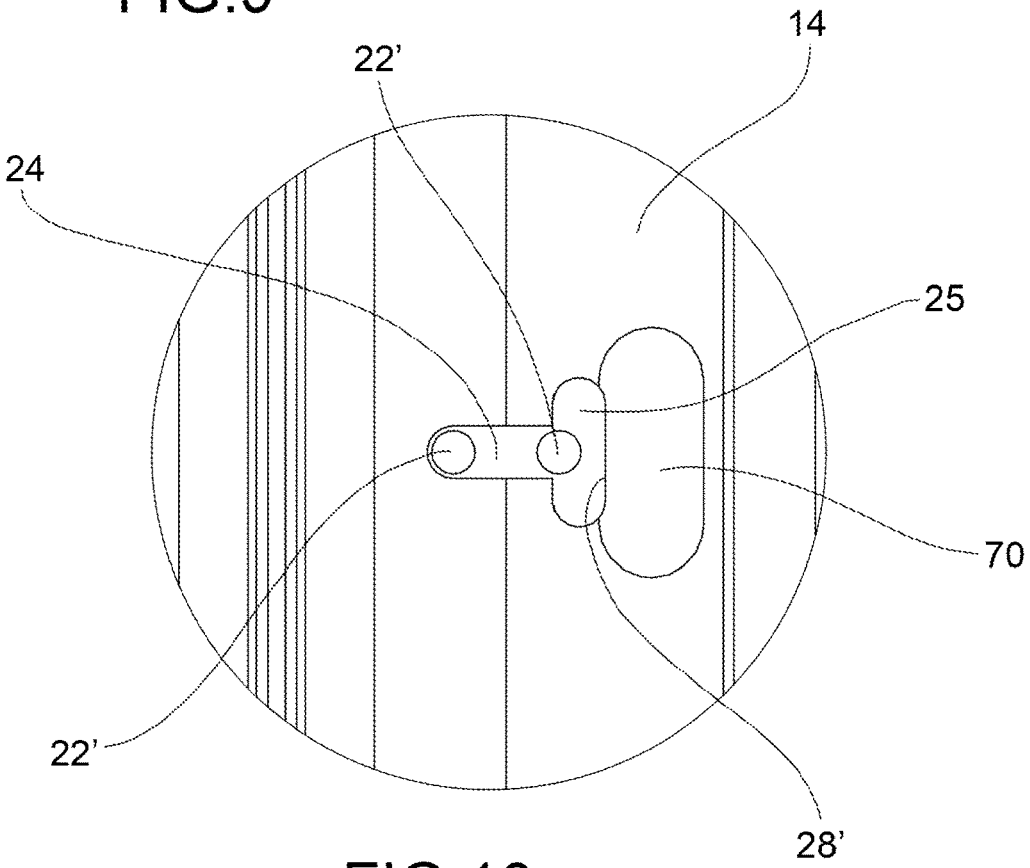
FIG. 10 is an enlarged view of circled detail C in FIG. 9.
Figure 11:
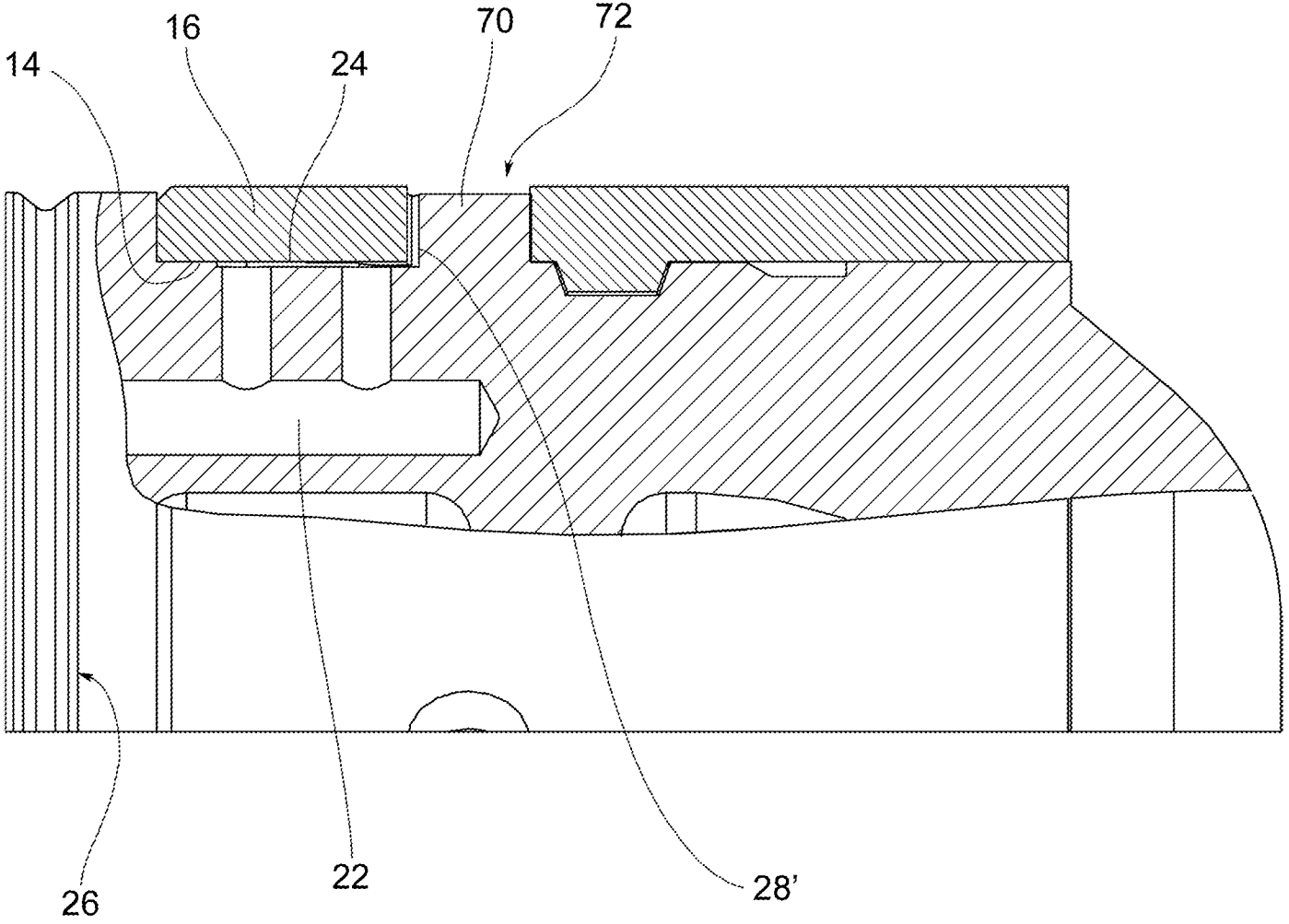
FIG. 11 is a partial axial section view of the piston head in FIGS. 9 and 10, provided with sealing ring.

FIGS. 9 to 11 show an alternative embodiment of the piston head 1001 in FIG. 8. Rather than ending at the base of the annular shoulder 26, each surface channel 24 in this embodiment ends at the base of a respective radial protrusion 70, therefore in a more advanced axial position with respect to the annular shoulder 26.

Also in this case, the radial protrusion 70 forms, at the surface channel 24, an axial recess 28' suitable to locally increase the passage cross-section of the lubricant in the gap between the radial protrusion and the sealing ring 16.

In this embodiment, the lubricant can be brought into an even more advanced area of the piston head. This can be useful because certain die-casting machines employing a piston according to the invention do not have a sufficient stroke for the piston to come out of the container in such a measure as to allow the lubricant to cover the entire front area of the container. A more advanced area, even with a smaller or equal stroke, can in any case be lubricated with this new embodiment.

Moreover, more axially extended sealing rings 16 can be made by causing the lubricant to flow out at the radial protrusions 70, without requiring to retract the outflow of the lubricant up to the rear shoulder, thus partly nullifying the advantages of the lubrication circuit.

In certain embodiments, the axial recess 28; 28' obtained in the annular shoulder 26 or in the radial protrusions 70 has a circumferential amplitude which is greater than the width of the surface channel 24.

In certain embodiments, the end of the surface channel 24, both if it is facing the back towards the annular shoulder 26 and if it is facing the front towards the radial protrusion 70, forms a circumferential discharge 25 substantially corresponding to the amplitude of the axial recess 28; 28'.

As shown in FIGS. 9 and 10, the surface channel 24 therefore is "T"-shaped, which further promotes the outflow and the circumferential distribution of the lubricant.

A person skilled in the art may make changes and adaptations to the embodiments of the piston head, head assembly and piston according to the invention, or can replace elements with others which are functionally equivalent to satisfy contingent needs without departing from the scope of protection of the following claims. All of the features described as belonging to a possible embodiment can be achieved irrespective of the other embodiments described.

The invention claimed is:

1. A head assembly comprising:

a piston head for making a piston of a press for a die-casting machine, comprising:

a head body having a side wall extending around a head axis, and at least one ring seat obtained in the side wall and suitable to receive a respective sealing ring, the at least one ring seat forming a cylindrical bottom wall parallel to the head axis and being delimited by at least one annular shoulder obtained in the head body; and a sealing ring housed in the at least one ring seat, wherein at least one gap is formed between said sealing ring and the at least one annular shoulder;

wherein:

a lubrication circuit is obtained in the head body and is suitable to facilitate the sliding of the piston in a respective container of the die-casting machine, the lubrication circuit comprises at least one lubrication end duct leading into the at least one ring seat so as to be covered by the sealing ring, and at least one lubrication end duct leads into a surface channel which runs through the bottom wall, said surface channel ending at a base of said at least one annular shoulder in order to convey a lubricant towards the at least one gap for the outflow of the lubricant from the at least one gap.

2. The head assembly according to claim 1, wherein radial protrusions suitable to engage, with shape coupling, corresponding openings made in the sealing ring so as to make an axial and radial locking system of the sealing ring, extend from the cylindrical bottom wall, and wherein each surface channel ends at a base of a respective radial protrusion.

3. The head assembly according to claim 1, wherein the surface channel extends parallel to the head axis.

4. The head assembly according to claim 1, wherein the annular shoulder or a radial protrusion forms, at the surface channel, an axial recess suitable to locally increase the passage cross-section of the lubricant in the gap between the annular shoulder or the radial protrusion and the sealing ring.

5. The head assembly according to claim 4, wherein the axial recess has a circumferential amplitude which is greater than the width of the surface channel, and wherein the end of the surface channel forms a circumferential discharge substantially corresponding to the amplitude of the axial recess.

6. The head assembly according to claim 1, wherein the surface channel has a bottom wall in the form of a cylindrical surface portion.

7. The head assembly according to claim 1, wherein the surface channel is axially delimited by two parallel edges, and wherein an outlet opening of the at least one lubrication end duct has a circular cross-section with a diameter greater than the distance between said parallel edges.

8. The head assembly according to claim 1, wherein the surface channel is axially delimited by two parallel edges, and the surface channel forms, at an outlet opening of each end duct, a circular cross-section with a diameter greater than a distance between the two parallel edges.

9. The head assembly according to claim 1, wherein the sealing ring comprises a substantially circular annular rear wall suitable to be axially engaged by the annular shoulder.

10. The head assembly according to claim 1, wherein slots suitable to be engaged by respective radial protrusions extending from the at least one ring seat are obtained in the sealing ring.

11. The head assembly according to claim 1, wherein the sealing ring is interrupted by a longitudinal slit.

12. A piston for a die-casting machine, comprising the head assembly according to claim 1 and a rod extending between a rear end and a front end connecting to the head assembly, one or more lubricant supply ducts fluidically connected to the at least one lubrication end duct being obtained in the rod.

* * * * *